United States Patent [19]

Gerdsen et al.

[11] Patent Number: 4,665,853

[45] Date of Patent: May 19, 1987

[54] FOIL ARRANGEMENT FOR A PLANNING CRAFT

[75] Inventors: Hans G. Gerdsen, Nordenhamer Weg 5, 2874 Lemwerder; Wolfgang Jabbusch, Oldenburg, both of Fed. Rep. of Germany

[73] Assignee: Hans Gerd Gerdsen, Lemwerder, Fed. Rep. of Germany

[21] Appl. No.: 853,685

[22] Filed: Apr. 18, 1986

[30] Foreign Application Priority Data

Apr. 19, 1985 [DE] Fed. Rep. of Germany ..... 3514195

[51] Int. Cl.[4] ..... B63B 1/12

[52] U.S. Cl. ..... 114/61; 114/274; 114/280

[58] Field of Search ..... 114/61, 126, 152, 283, 114/274, 277, 278, 280

[56] References Cited

U.S. PATENT DOCUMENTS

| | | | |
|---|---|---|---|
| 2,274,200 | 2/1942 | Hill | 114/274 |
| 2,890,672 | 6/1959 | Boericke | 114/274 |
| 4,552,083 | 11/1985 | Schmidt | 114/61 |
| 4,606,291 | 8/1986 | Hoppe | 114/61 |

FOREIGN PATENT DOCUMENTS

| | | | |
|---|---|---|---|
| 46851 | 10/1936 | France | 114/274 |
| 1081063 | 12/1954 | France | 114/274 |
| 1523480 | 5/1968 | France | 114/274 |
| 1524938 | 9/1978 | United Kingdom | 114/274 |
| 2121731 | 1/1984 | United Kingdom | 114/61 |

*Primary Examiner*—Joseph F. Peters, Jr.
*Assistant Examiner*—Stephen P. Avila
*Attorney, Agent, or Firm*—Collard, Roe & Galgano

[57] ABSTRACT

A catamaran including two hulls defining a tunnel between them. The tunnel is bridged below the waterline by transversely arranged hydrofoils. The relatively larger mainfoil is located behind, and the smaller trimfoil in front of, the longitudinal center of gravity of the catamaran. This arrangement considerably reduces the high hump resistance of the catamaran.

17 Claims, 11 Drawing Figures

FOIL ARRANGEMENT FOR A PLANNING CRAFT

BACKGROUND OF THE INVENTION

The invention relates to a catamaran having two spaced apart substantially parallel demihulls connected by a deck structure above the waterline. A tunnel is formed between the two demihulls in which, below the waterline, transverse hydrofoils are arranged.

It is known that the resistance of planing catamarans can be improved by arranging hydrofoils in the tunnel between the demihulls such that the foils carry a certain part of the weight of the boat. Such arrangements are described in European patent applications Nos. 015 073 and 0 094 673, with the latter describing a pair of hydrofoils in a tandem arrangement with the mainfoil placed close to the center of gravity and a trimfoil disposed near the stern. The pair of foils are arranged in such a way that their running orientation or level is parallel to the water surface when the catamaran has adjusted itself to a trim angle at running speed. The combined lift forces of all foils have to act close to the longitudinal center of gravity.

Although this foil arrangement has proven successful, it still has certain disadvantages. Specifically, at the beginning of the planing condition, the catamaran will take a certain trim angle which increases the pressure resistance of the craft. Before the catamaran has been raised partially out of the water by the dynamic lift forces, an extraordinary increase of resistance (known as hump resistance) occurs. At higher speeds of the catamaran, the trim angle decreases again and the resistance increase is less steep.

The arrangement of hydrofoils according to European patent application No. 0 094 673 still has a relatively high hump resistance due to the fact that the mainfoil is located in front of the longitudinal center of gravity and carries a higher weight than the trimfoils. This causes the induced downwash behind the mainfoil to be relatively strong, especially at low speed. With increasing speed the downwash decreases in relation to the velocity of the flow past the foil. The downwash changes the angle of attack of the trimfoil at the stern. The angle of attack of the trimfoil is then decreased and the lift forces of the trimfoils are reduced, causing a further increase of hump resistance. For smaller catamarans with a high reserve of engine power this fact is not so important.

However, with larger craft having design speeds not much higher than the hump resistance speed, it is absolutely necessary to prevent any increase in the hump resistance.

It is therefore an object of the present invention to provide a catamaran having improved hump resistance characteristics achieved by a hydrofoil arrangement.

SUMMARY OF THE INVENTION

The foregoing and related objects are readily obtained in a catamaran wherein the mainfoil is positioned a relatively small distance behind the longitudinal center of gravity, and the trimfoil is positioned a farther distance in front of it in order to keep the hump resistance as low as possible.

The mainfoil has a larger projected area than the trimfoil and the foils are located in such a way that the resultant of their dynamic lift forces operates at or close to the longitudinal center of gravity. The trimfoil is vertically disposed as close as possible to the lower end of the keel. The mainfoil is arranged above the keel end in such way that at design speed, when the boat runs under the designed trim angle, the hydrofoils have the same relative draft.

The mainfoil is located behind the longitudinal center of gravity of the catamaran and generates a trim reducing moment. The restoring moment of the mainfoil reduces the natural trim of the boat, so that the downwash of the trim foils have only a negligible effect on the mainfoil. The reason for this relatively small effect is based on the relatively small load of the trimfoil and its higher position under a relatively higher trim angle. Therefore this arrangement provides smaller trim angles at hump speed, thereby reducing the hump resistance. This foil arrangement also offers improved physical foil-lift conditions and better efficienty.

Another advantage of the catamaran of the present invention is its improved seakeeping performance in rough seas. When the instant catamaran runs into a wave, the buoyancy and the lift forces in the front part of the boat will be increased, causing a higher trim angle of the craft. The trim angle of the mainfoil will also be increased, causing a higher lift which will counteract the increase of the trim angle of the vessel. The trim foil has less effect on the trim due to its relatively small lift forces. At design speed, the foils have the same relative draft. When the catamaran runs into the wave crest, the trim reducing moment of the mainfoil will be relatively small because of its relatively short distance to the longitudinal center of gravity, and because the reduced draft effects less lift of the mainfoil. The catamaran will therefore have much less trim motion, i.e., pitching and heaving motion, thereby increasing the speed potential of the boat considerably.

In contrast, the catamaran according to European Patent Application No. 0 094 673 has a completely different seakeeping behavior. The dynamic lift forces which are generated when running into a wave will be increased as the mainfoil lifts, causing a higher trim angle, which adds even more lift to the mainfoils. The downwash of the mainfoils generated thereby reduces the efficiency of the rear trimfoils. When the catamaran leaves the wave the mainfoil will suddenly have much less lift, and the velocity of its downwash causes an increased lift of the rear trimfoil, resulting in stronger trim motions, which leads to less seakeeping capability. In contrast, the novel foil arrangement of the present invention improves the catamarans seakeeping characteristics.

In a preferred embodiment of the invention, the mainfoil extends entirely across the full tunnel width, and the trimfoil comprises two foils protruding into the tunnel from the walls. The mainfoil has its best efficienty with maximum extension whereas the trimfoils carry less load and therefore do not need to extend entirely across the tunnel.

The design of the trimfoil as foil stubs has the advantage that the foils have a shorter wing span and are stiffer. Preferably, the trimfoils have a longitudinal sweep angle (i.e., a forward or backward sweep) and/or an upward or downward dihedral angle with respect to the tunnel walls, which provides a smoother operation, and an improved ability to deal with floating debris. The downwash of the trimfoil will also provide added protection to the mainfoil. Additionally, the mainfoils may have a form with a longitudinal backward or forward sweep angle, preferably of from approximately 2°-5°, in order to provide for a smoother ride. The mainfoil can also consist of protruding foil stubs, which may be necessary for widely tunnelled and very fast catamarans.

In another embodiment of the invention, the demihulls are built as fully asymetrical planing hulls with a deep-V characteristic wherein the tunnel has vertically straight tunnel walls which are parallel to each other. This form of tunnel generates a relatively undisturbed flow of water therein, and therefore allows for an undisturbed operation of the foils positioned in the tunnel. The combination of the deep-V hull form, which has already proven its superior seakeeping ability, and the hydrofoils with their dampening and stabilizing properties, provides considerably improved seakeeping behavior.

The trimfoils may be adjustable in height, either by moving the trimfoils up and down or by adjusting their swivel angle. The trimfoils can then be adjusted to the optimum trim in different wave conditions. There is also the possibility of adjusting the mainfoil angle of attack according to the catamaran's speed, e.g., in order to increase the lift in the hump region.

Most desirably, the area of the mainfoil is about 70 to 75% of the total foil area, and the center of lift pressure is about 8 to 15% of the length of the ship behind the longitudinal center of gravity. The trimfoil is also located close to the base-line about 20 to 30% of the length of the ship in front of the longitudinal center of gravity. This arrangement has the advantage of providing a good trim balance without positioning the trimfoils too far in front where they would be in the area of the highest accelerations.

In another preferred embodiment of the invention, a starting foil similar to the mainfoil is positioned above the mainfoil with its dynamic center of lift close to or behind the center of lift of the mainfoil, such that the starting foil will be out of the water at design speed. This arrangement is intended to reduce the hump resistance, in order to adjust the curves of a diesel engine to the propeller curve defined by the resistance of the craft. In order to reduce the hump resistance to a higher degree, the starting foil can have a cross section having a higher lift at low speed. Since the starting foil is above the mainfoil, it will be out of the water when the catamaran is traveling over the hump speed.

In another version of the invention, the starting foil and the mainfoil are connected by at least one vertical strut which is hydrodynamically shaped. The strut is preferably positioned to the rear of the two foils in order to avoid disturbing them. This strut can also be extended to the underside of the deck structure or the tunnel ceiling to provide a higher system stiffness. The cross section of the mainfoil and the starting foil can be varied according to the different speed ranges which they are designed for. The angle of attack of the two foils may be similarly adapted. The angle of attack of the foils can also be adjusted individually or in combination.

Other objects and features of the present invention will become apparent from the following detailed description considered in connection with the accompanying drawings, which disclose several embodiments of the invention. It is to be understood that the drawings are to be used for the purpose of illustration only, and not as a definition of the limits of the invention.

BRIEF DESCRIPTION OF THE INVENTION

In the drawings, wherein similar reference characters denote similar elements throughout the several views.

DETAILED DESCRIPTION OF THE PREFERRED EMBODIMENTS

Figure 1:
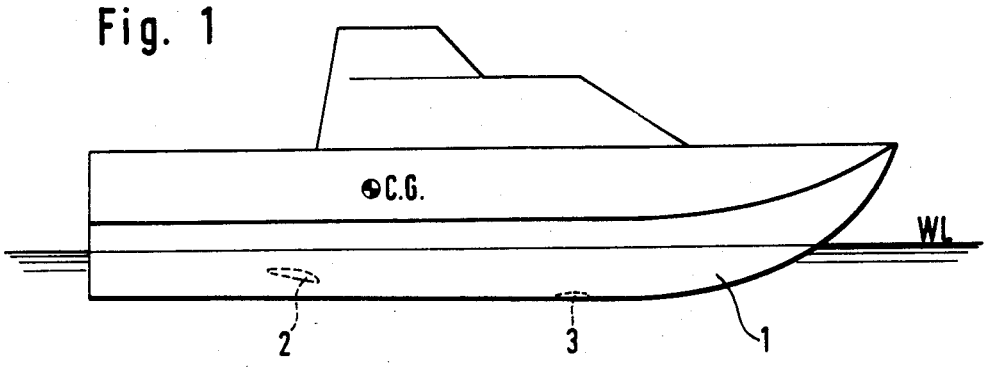
FIG. 1 is a schematical side view of the catamaran embodying the present invention at rest.
Figure 2:
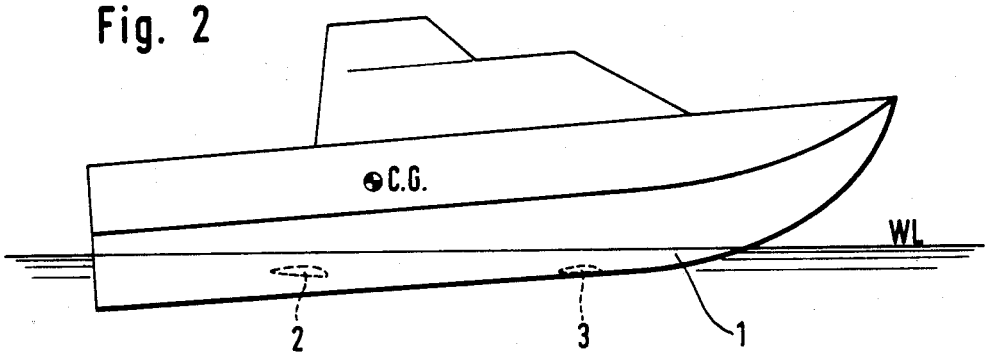
FIG. 2 is a schematical side view of the catamaran of FIG. 1 moving at design speed.
Figure 3:
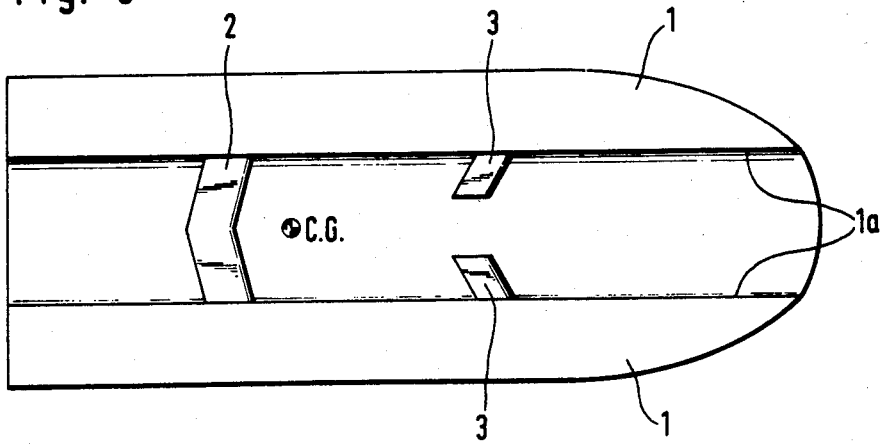
FIG. 3 is a schematical bottom view of the catamaran of FIG. 1.
Figure 4:
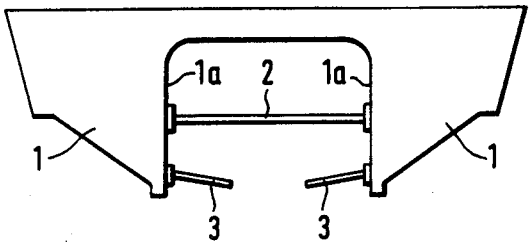
FIG. 4 is a schematical left end view of the catamaran of FIG. 1 showing the tunnel thereof.
Figure 5:
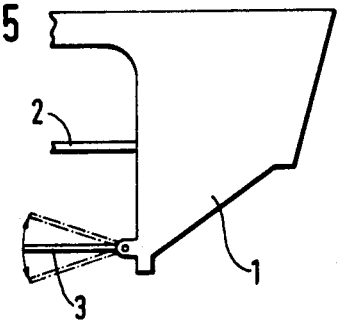
FIG. 5 is an enlarged, fragmentarily-illustrated schematical left end view of the tunnel of the catamaran, showing the catamaran with an adjustable trim foil.
Figure 6:
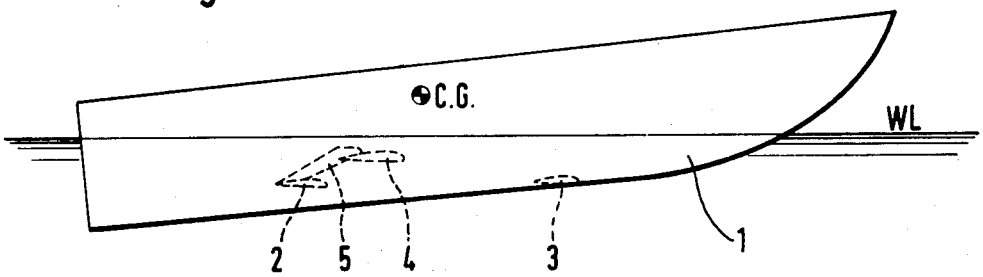
FIG. 6 is a schematically-illustrated side view, in part section, of the catamaran of FIG. 1 with an additional starting foil.
Figure 7:
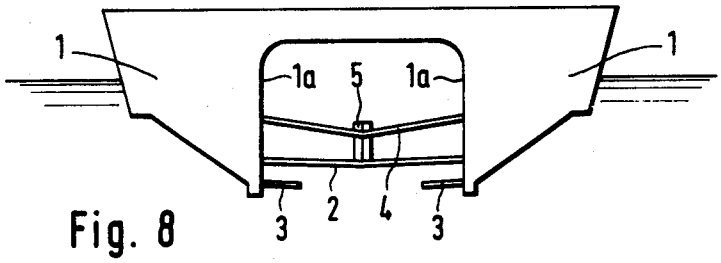
FIG. 7 is a schematical left end view of the catamaran of FIG. 6.
Figure 8:
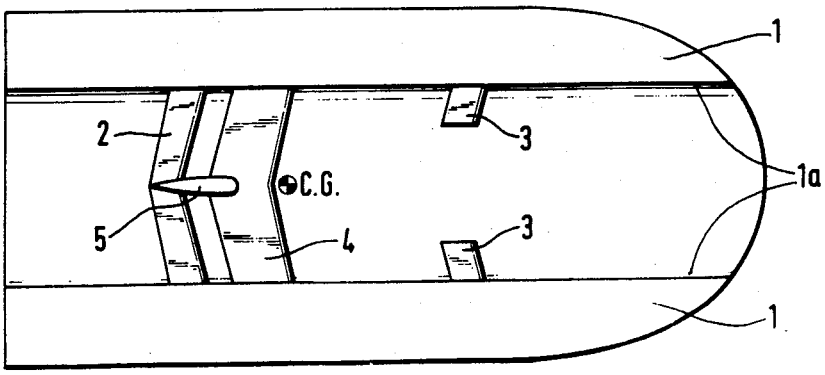
FIG. 8 is a schematical bottom view of the catamaran of FIG. 6.
Figure 9:
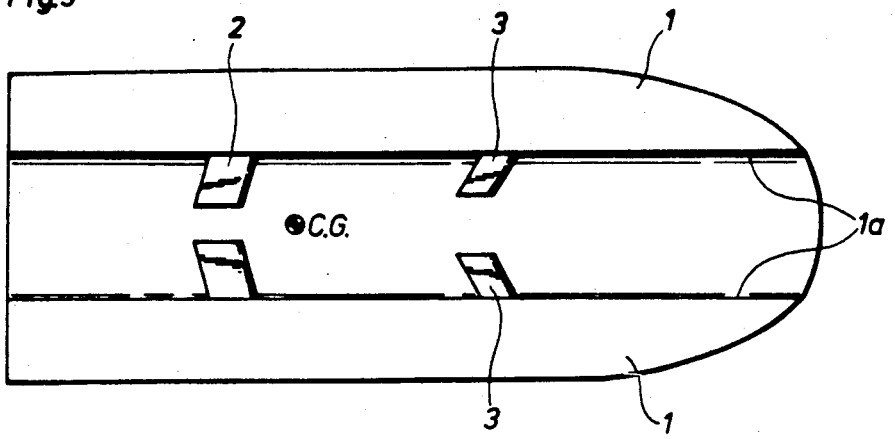
FIG. 9 is a schemmatical bottom view of another embodiment of the invention wherein the main foil comprises two foils extending partially into the tunnel.
Figure 10:
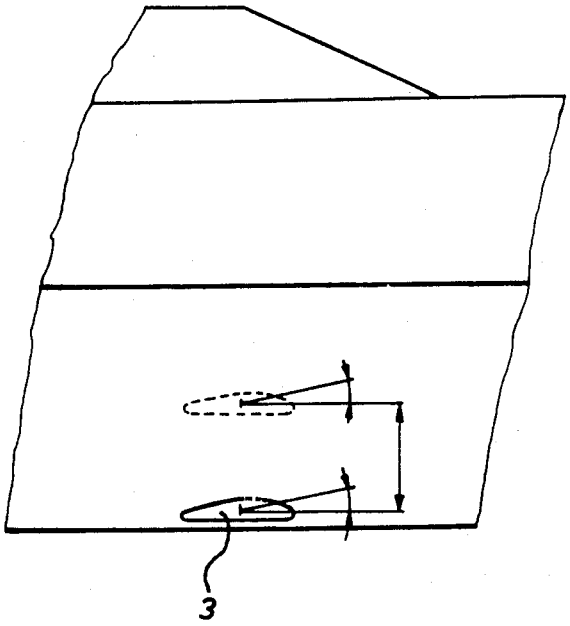
FIG. 10 is an enlarged, fragmentarily illustrated schemmatical side view, in part section, of the catamaran of FIG. 1, having trim foils which are adjustable vertically and in their angle of attack.
Figure 11:
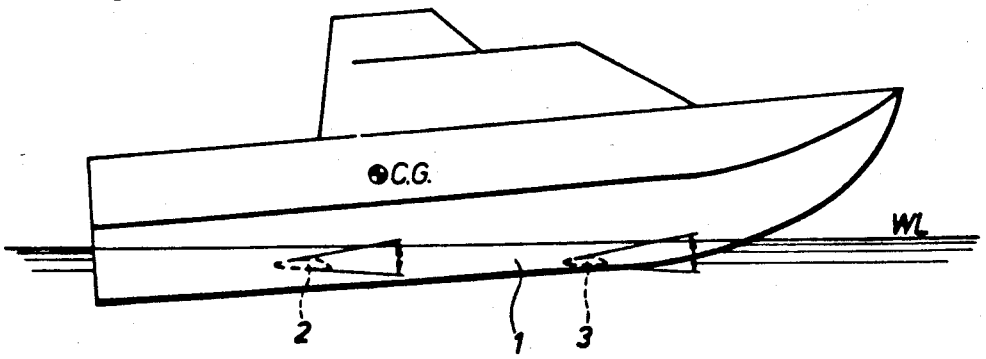
FIG. 11 is a schemmatical side view of the catamaran of FIG. 1 wherein the main foil and trim foil have angles of attack which are individually adjustable.

Turning now in detail to the appended drawings, therein illustrated is a novel catamaran embodying the present invention, which as shown in FIGS. 1 to 4 has two hulls which are fully symetrical demihulls having parallel tunnel walls 1*a*. The tunnel is bridged by the mainfoil 2 and two trimfoil stubs 3 project therein to form opposing walls 1*a*. Larger main foil 2 is located a small distance behind the longitudinal center of gravity, e.g., close to the keel of the catamaran and trimfoil stubs 3 are located at a larger distance in front of the longitudinal center of gravity and close to edge of the keel. The combined lift of the hydrofoil acts approximately at the longitudinal center of gravity. FIG. 5 shows the arrangement of trimfoil stubs 3 which are adjustable by a swivel device, with alternate trimfoil positions, shown in phantom. FIGS. 6 and 7 illustrate the catamaran of FIG. 1 having an additional starting foil 4. FIG. 9 shows an embodiment where the main foil includes two individual foils protruding out of opposite walls of the demihulls and extending partially into the tunnel. FIGS. 10 and 11 schemmatically illustrate, respectively, a catamaran according to the invention having trim foils which are adjustable vertically and in their angle of attack, and wherein the main foil and trim foil have angles of attack which are individually adjustable.

Thus, while several embodiments of the present invention have been shown and described, it is obvious that many changes and modifications may be made thereunto, without departing from the spirit and scope of the invention.

What is claimed is:

1. In a catamaran of the type having two spaced-apart, substantially parallel demihulls joined by a deck structure above the waterline forming a tunnel, said demihulls having a waterplate at the design speed which forms the planing angle with the keel lines of the demihulls, the improvement comprising:

a mainfoil and a trimfoil disposed at an angle of attack withing said tunnel below the waterline and respectively positioned a relatively short distance aft, and a relatively longer distance fore of the longitudinal center of gravity of the catamaran, said main and trimfoils effecting dynamic lift forces at the design speed having a resultant acting closely adjacent to the longitudinal center of gravity, said trimfoil disposed adjacent to the keel of the demihulls and vertically below said mainfoil such that when the catamaran moves at the design speed, said foils have approximately equal drafts.

2. The catamaran as claimed in claim 1, wherein said mainfoil has an area of about 3 to 5 times the area of the trimfoil and is attached to the demihulls between 8% to 15% of the ship length aft of the longitudinal center of gravity position and the trimfoil is located 20% to 30% of the ship length foreward of the center of gravity position.

3. The catamaran as claimed in claim 1, wherein said mainfoil extends across the tunnel between the demihulls and said trimfoil consists to two strut-foil-elements attached to the opposite walls of the tunnel in mirror image arrangement.

4. The catamaran as claimed in claim 1, wherein said mainfoil consists of two strut-foil-elements attached to the opposite walls of the tunnel in mirror image arrangement.

5. The catamaran as claimed in claim 3, in which said trimfoil struts have a sweep angle in the horizontal plane.

6. the catamaran as claimed in claim 5, said trimfoil struts have a slight dihedral angle with respect to said tunnel walls.

7. The catamaran as claimed in claim 1, wherein said mainfoil has an adjstable sweep angle in the horizontal plane.

8. The catamaran as claimed in claim 1, wherein said mainfoil has a dihedral angle of between 2° to 5° with respect to said tunnel walls.

9. The catamaran as claimed in claim 1, wherein said trimfoil is vertically adjustable.

10. The catamaran as claimed in claim 1, wherein the trimfoil attack angle is adjustable.

11. The catamaran as claimed in claim 1, which further includes a starting foil disposed vertically beneath the center of gravity of the catamaran at a height above the waterline at the design speed and below the waterline at rest.

12. The catamaran as claimed in claim 11, wherein said starting foil and said mainfoil are connected by at least one streamlined vertical strut attached at the aft parts of said foils.

13. The catamaran as claimed in claim 12, wherein said starting foil has a forward or backward sweep angle in the horizontal plane.

14. The catamaran as claimed in claim 13, wherein said starting foil has a dihedral angle of between 2° to 5° with respect to said tunnel walls.

15. the catamaran as claimed in claim 11, wherein said mainfoil and trimfoil have a shape favorable for high speeds and said starting foil has a shape favorable for lower speeds.

16. The catamaran as claimed in claim 1, wherein the angle of attack of the mainfoil is adjustable.

17. The catamaran as claimed in claim 1, in which said demihulls are fully asymmetrical planing hulls with deep-V-shape and straight flat vertical parallel walls inside the tunnel.

* * * * *